US006112805A

United States Patent [19]

Uehara et al.

[11] Patent Number: 6,112,805

[45] Date of Patent: Sep. 5, 2000

[54] CONTINUOUS CASTING MOLD FOR BILLET

[75] Inventors: Masatsugu Uehara; Toshiki Sato, both of Kitakyushu; Teruo Fujinaga; Kazutoki Nakao, both of Saga, all of Japan

[73] Assignee: Nippon Steel Corporation, Tokyo, Japan

[21] Appl. No.: 09/473,085

[22] Filed: Dec. 28, 1999

Related U.S. Application Data

[63] Continuation of application No. 08/702,611, filed as application No. PCT/JP95/02704, Dec. 26, 1995, Pat. No. 6,024,162.

[30] Foreign Application Priority Data

Dec. 28, 1994 [JP] Japan ..... 6-340601
Oct. 9, 1995 [JP] Japan ..... 7-287837

[51] Int. Cl.[7] ..... B22D 11/051

[52] U.S. Cl. ..... 164/416; 164/418

[58] Field of Search ..... 164/416, 418, 164/459, 478

[56] References Cited

U.S. PATENT DOCUMENTS 4,250,950 2/1981 Buxmann et al. ..... 164/418 X

FOREIGN PATENT DOCUMENTS

| | | | |
|---|---|---|---|
| 2658440 | 8/1991 | France | 164/418 |
| 51-50819 | 5/1976 | Japan | 164/418 |
| 51-25411 | 7/1976 | Japan . | |
| 53-70038 | 6/1978 | Japan . | |
| 57-11735 | 3/1982 | Japan . | |
| 1-170550 | 7/1989 | Japan | 164/418 |
| 1-289542 | 11/1989 | Japan | 164/418 |
| 2-20645 | 1/1990 | Japan . | |
| 2-70357 | 3/1990 | Japan | 164/418 |
| 2-207945 | 8/1990 | Japan . | |
| 2-220738 | 9/1990 | Japan | 164/418 |
| 6-297101 | 10/1994 | Japan . | |
| 6-297103 | 10/1994 | Japan . | |
| 338040 | 8/1986 | U.S.S.R. | 164/418 |

*Primary Examiner*—J. Reed Batten, Jr.
*Attorney, Agent, or Firm*—Kenyon & Kenyon

[57] ABSTRACT

Recess portions each comprising one or a plurality of transverse grooves or a large number of dimples are disposed below the lowermost position of a meniscus under a steady operation state within a distance of 200 mm on the inner peripheral surface of the casting mold so that a solidified shell is gradually cooled and the cooling capacity of each inner surface of the casting mold is substantially inform.

6 Claims, 14 Drawing Sheets

CONTINUOUS CASTING MOLD FOR BILLET

This application is a continuation application under 37 C.F.R. § 1.53(b) of prior application Ser. No. 08/702,611 filed Nov. 21, 1996, now U.S. Pat. No. 6,024,162 which is a 35 U.S.C. §371 of PCT/JP95/02704 filed Dec. 26, 1995. The disclosures of the specification, claims, drawings, and abstract of application Ser. No. 08/702,611 and PCT/JP95/02704 are incorporated herein by reference.

TECHNICAL FIELD

This invention relates to a continuous casting method for a square having less rhomboidity deformation or a round billet having side periphery deformation and to a casting mold used for the method.

BACKGROUND ART

To continuously cast a billet, a molten steel 51 is charged into a casting mold 50, having a substantially square inner section and oscillating up and below from a tundish above the casting mold as shown in FIG. 18, and a solidified shell 52 is formed on the inner surface of the casting mold while heat is absorbed from the side surface of the casting mold 50 which is cooled with water. The solidified shell 52 is then drawn out gradually, and the molten steel 51 at a core portion, too, is gradually solidified so as to form a billet.

To accomplish lubrication between the inner surface of the casting mold and the solidified shell 52, rape seed oil (an example of the lubricant) is charged little by little from above the casting mold 50, and is then carbonized to obtain a lubricant.

However, when casting of the billet is carried out at a high speed (at 3 m/min, for example), a difference in solidification shrinkage occurs because the gap between the solidified shell 52 around the four outer periphery surfaces of the billet and the casting mold 50 is not uniform, and the section of the product becomes a rhomboid. In a round billet, side periphery deformation such as an oval section of the product or the occurrence of a recess takes place. For this reason, the continuous casting method of the billet according to the prior art has been carried out within an allowable speed range in which this rhomboidity, i.e. rhomboid deformation, does not occur, and the problems of a relatively low speed of the casting speed and low productivity are yet left unsolved.

In the case of continuous casting of slabs having a rectangular section, on the other hand, Japanese Examined Patent Publication (Kokoku) No. 57-11735 proposes a casting mold for continuous casting which is directed to prevent longitudinal cracks of a slab and damage such as slag bite by disposing uniformly a large number of recesses having a width or diameter of not greater than 2.5 mm at a part of the inner surface or the whole inner surface of the casting mold. It has been found out that when this technology is applied to continuous casting of billets, the recessed portions are gradually filled with carbon powder as the lubricant because the diameter of the recessed portions is not greater than 2.5 mm, and stable casting cannot be conducted.

SUMMARY OF THE INVENTION

In view of the technical background described above, the present invention is directed to provide a continuous casting method, for a billet, capable of conducting stable casting at a high speed without causing rhomboidity in the billet produced by continuous casting, and a casting mold used for this method. The gists of the invention are as follows.

(1) A continuous casting method of a billet for effecting casting by charging a molten metal from the upper portion into a casting mold oscillating in a vertical direction characterized in that:

recess portions each comprising one or a plurality of transverse grooves or a large number of dimples are formed on the four inner peripheral surfaces of the casting mold below, and within a distance of 200 mm from, the lowermost position of a meniscus under a steady operation state so as to make the cooling capacity of each inner surface of the casting mold substantially uniform.

(2) A continuous casting method for a billet for effecting casting by charging a molten metal from the upper portion into a casting mold oscillating in a vertical direction and by charging a small amount of a lubricant, characterized in that:

recess portions each comprising one or plurality of transverse grooves or a large number of dimples are formed on the four inner peripheral surfaces of the casting mold below, and within a distance of 200 mm from, the lowermost position of a meniscus under a steady operation state, so as to make a cooling capacity of each inner surface of the casting mold substantial uniform.

(3) A casting mold oscillating in a vertical direction and having a substantially square inner section characterized in that:

transverse grooves having a mean recess depth of at least 20 $\mu$m and having the width (W) thereof satisfying the following formula (1) are disposed on the inner surface of the casting mold at positions below, and within a distance of 200 mm from, the lowermost position of a meniscus under a steady operation state.

$$3\ \text{mm} \leqq W \leqq (\text{oscillation amplitude of the casting mold}) \times 2 + 10\ \text{mm} \quad (1)$$

(4) A casting mold oscillating in a vertical direction and having substantially square inner section characterized in that:

a large number of dimples having a mean recess depth of at least 20 $\mu$m and having the diameter (D) thereof satisfying the following formula (2) are disposed with gaps between them on the inner surface of the casting mold at positions below, and within a distance of 200 mm from, the lowermost position of a meniscus under a steady operation state.

$$3\ \text{mm} \leqq D \leqq (\text{oscillation amplitude of the casting mold}) \times 2 + 10\ \text{mm} \quad (2)$$

(5) A casting mold oscillating in a vertical direction and having a substantially square inner section characterized in that:

the inner surface of the casting mold is tapered in such a fashion that the inner surface distance thereof progressively decreases downward, and transverse grooves having a mean recess depth of at least 20 $\mu$m and having the width (W) thereof satisfying the following formula (1) are disposed on the inner surface of the casting mold at positions below, and within a distance of 200 mm from, the lowermost position of a meniscus under a steady operation state.

$$3\ \text{mm} \leqq W \leqq (\text{oscillation amplitude of the casting mold}) \times 2 + 10\ \text{mm} \quad (1)$$

(6) A casting mold oscillating in a vertical direction and having a substantially square inner section characterized in that:

the inner surface of the casting mold is tapered in such a fashion that the inner surface distance thereof progressively decreases downward, and a large number of dimples having a mean recess depth of at least 20 μm and having the diameter (D) thereof satisfying the following formula (2) are disposed with gaps between them on the inner surface of the casting mold at positions below, and within a distance of 200 mm from, the lowermost position of a meniscus under a steady operation state.

$$3\ \text{mm} \leqq D \leqq (\text{oscillation amplitude of the casting mold}) \times 2 + 10\ \text{mm} \quad (2)$$

(7) A continuous casting method for a round billet according to item wherein an inner section of a casting mold is round, and the inner surface of the casting mold is tapered in such a fashion that the diameter thereof progressively decreases downward.

(8) A casting mold for a round billet according to item, wherein an inner section of a casting mold is round, and the inner surface of the casting mold is tapered in such a fashion that the diameter thereof progressively decreases downward.

BEST MODE FOR CARRYING OUT THE INVENTION

In the casting mold used for continuous casting of a billet according to the present invention, the recess portions comprising at least one transverse groove or a large number of dimples are disposed substantially uniformly on the inner surface of the casting mold. Therefore, gaps are compulsively formed between the billet and the casting mold. Since the inner surface of the casting mold is tapered in such a fashion that the inner surface distance thereof progressively decreases downward and eccentricity of the billet inside the casting mold can be prevented. Further, since a heat flux is reduced substantially uniformly, only a specific surface of the solidified shell does not come into close contact with the casting mold and is consequently cooled. As a result, the solidified shell undergoes shrinkage substantially uniformly and a billet having less rhomboidity can be produced even when casting is conducted at a high speed. Hereinafter, the technical feature of the present invention will be explained in detail.

Figure 2:
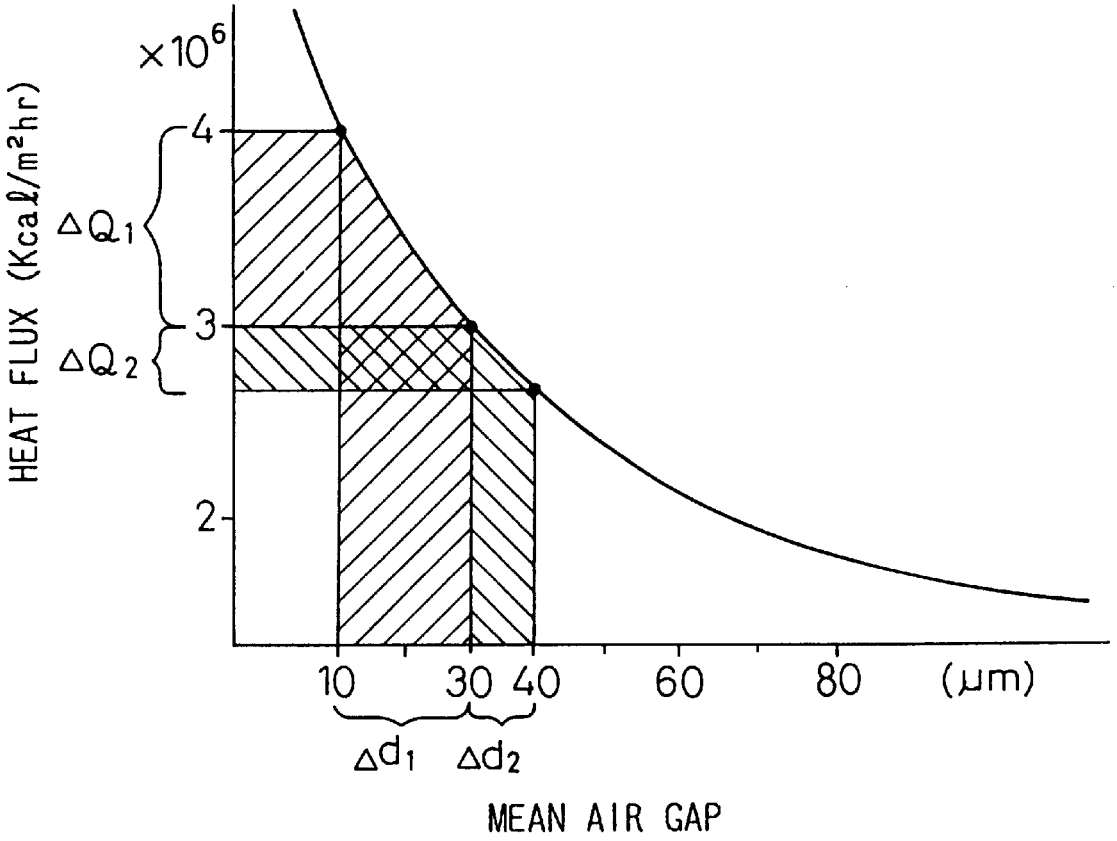
FIG. 2 is a graph showing the relationship between a mean air gap depth and a heat flux.

The heat flux carried from the molten metal to the casting mold is the greatest at positions below the lowermost position of a meniscus within a range of a distance of 200 mm from the meniscus lowermost position. The magnitude of this heat flux mainly depends on the air gaps between the solidified shell and the casting mold, and the relationship is shown in FIG. 2.

Figure 1A:
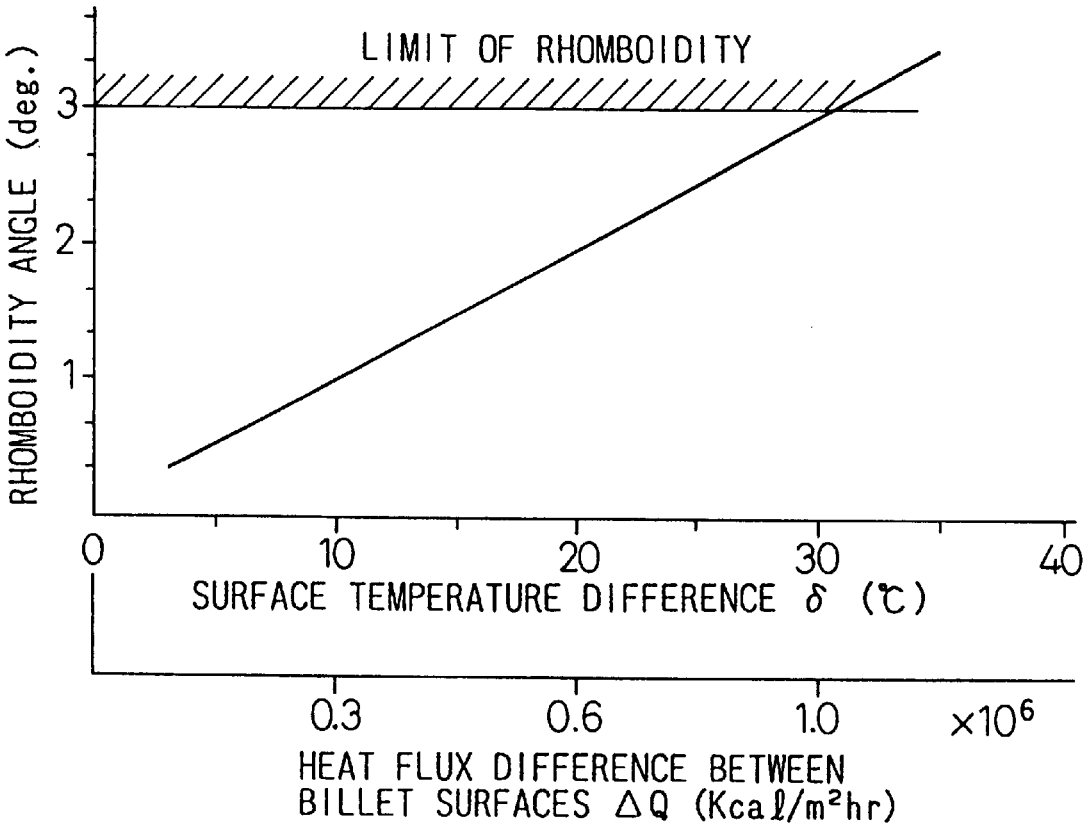
FIG. 1(*a*) is a graph showing the relationship between a heat flux difference between surfaces of a billet and a rhomboidity and FIG. 1(*b*) is a view showing rhomboidity of a billet.
Figure 1B:
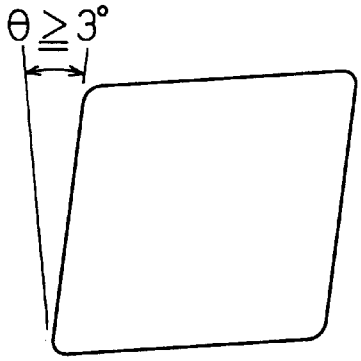

According to the conventional casting methods of the billet, eccentricity occurs in the billet due to the gap between the billet and the inner surface of the casting mold, so that the air gap between the casting mold and the solidified shell becomes non-uniform between the billet surfaces, and a difference $\Delta Q_1$ occurs in the heat flux between the billet surfaces. As a result, unbalance occurs in solidification shrinkage on the side surface of the billet, and a rhomboidicity occurs in the product. FIG. 1(*a*) is a graph showing the relationship between a heat flux difference between surfaces of a billet and rhomboidity and FIG. 1(*b*) is a view showing the rhomboidity of the billet. FIG. 1(*a*) shows the result of determination of the relationship between the heat flux difference of the billet surface and rhomboidity by experiment, and, in order to keep rhomboidity within the range of 3°, the graph shows that the relation $\Delta Q \leqq 1{,}000{,}000$ kcal/m$^2$hr must be satisfied. More, in a case of a round billet, it corresponds to side periphery deformation within the range of 3%.

Therefore, the following means are employed as means for reducing the heat flux difference $\Delta Q$.

① First, air gap (recess) portions having a predetermined depth are uniformly disposed below the meniscus so as to reduce the heat flux from 4,000,000 kcal/m$^2$hr to 3,000,000 kcal/m$^2$hr, for example.

② The mold taper is set to a taper having a suitable value so as to reduce the gap between the billet and the casting mold (for example, to reduce the mean air gap difference $\Delta d_1$ from 20 $\mu$m to 10 $\mu$m).

When these means ① and ② are used in combination, the heat flux difference between the surfaces of the billet can be reduced. Accordingly, the billet is uniformly cooled by the casting mold. Consequently, billets having fewer defects can be produced even at a high casting speed (e.g. 3.4 m/min).

Furthermore, in the study by the inventors, it was found that a gradual cooling effect due to an artificial air gap (recess) portion sufficiently reduces the heat flux difference, however, the heat flux difference cannot be reduced when the eccentricity of the casting (billet) is large. Therefore, it is preferable in the present invention to optimize the mold taper.

Figure 3:
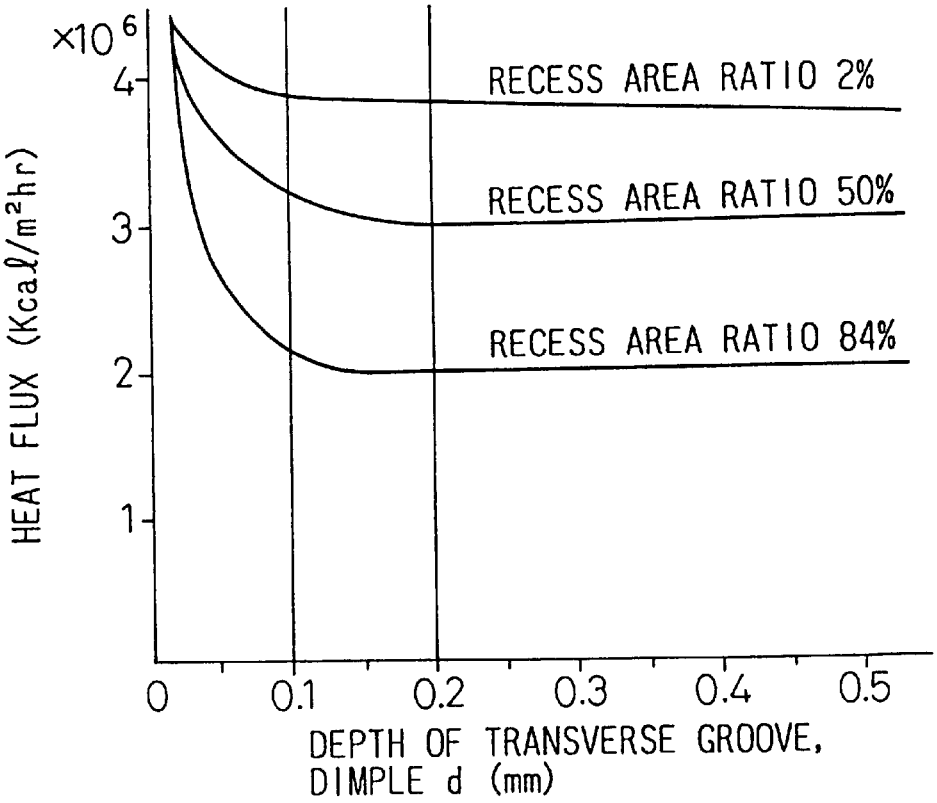
FIG. 3 is a graph showing the relationship between a transverse groove, dimple depth and heat flux.

Next, the gradual cooling effect by the air gap portion of the groove portion changes in accordance with a recess area ratio and a groove depth as shown in FIG. 3. The recess area ratio of about 2 to about 84% is effective for preventing rhomboidity. When this recess area ratio is smaller than 2%, the heat flux becomes so great that the temperature difference of the inner surface of the casting mold becomes great in the same way as in the prior art. When it exceeds 84%, the contact portion of the solidified shell with the casting mold decreases with the result being the increase of the wear of the inner surface of the casting mold and a shorter service life.

In connection with the groove depth, the degree of gradual cooling becomes substantially constant at a depth of at least 0.1 to 0.2 mm for the recess area ratio of several dozens of percents. Therefore, no substantial effect can be obtained even when the groove depth is increased beyond this value. The heat flux of the casting mold according to the present invention and the prior art will be explained below.

Figure 4A:
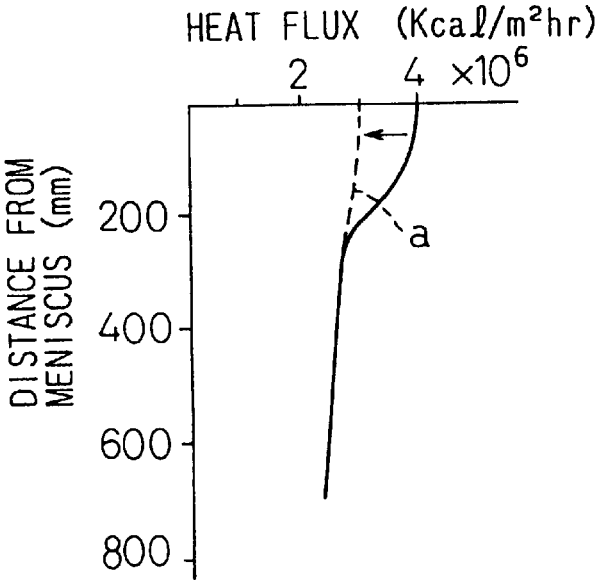
FIG. 4(*a*) is a view showing the relationship between distance from meniscus and heat flux, FIG. 4(*b*) is a view showing a profile of solidification shrinkage in the prior art and FIG. 4(*c*) in the present invention.
Figure 4B:
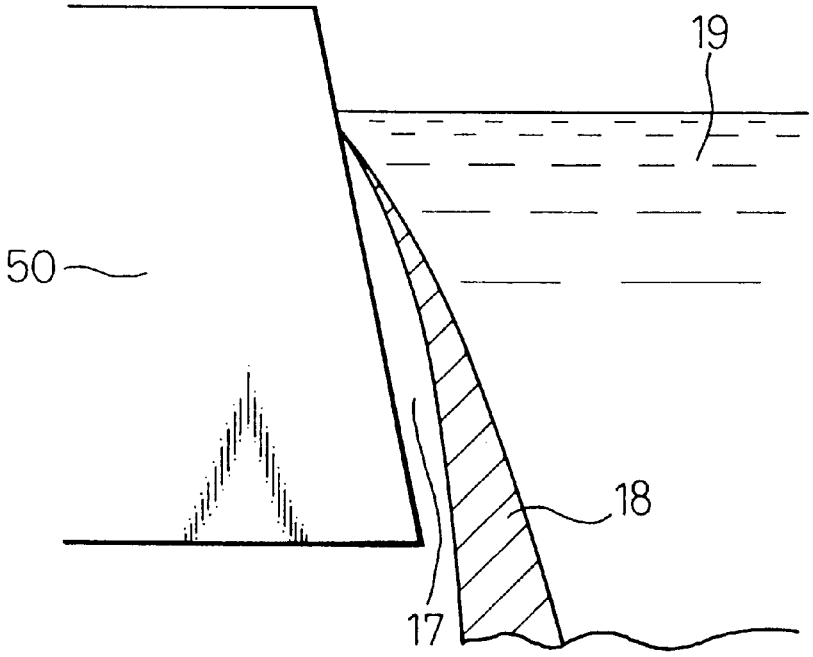
Fig.4(b) PRIOR ART
Figure 4C:
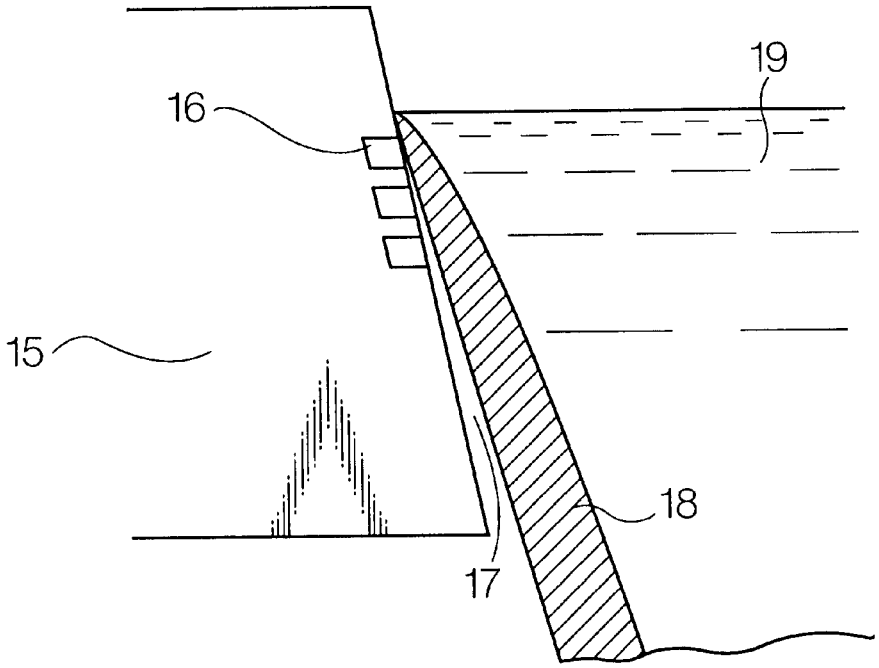

In the conventional continuous casting methods, the heat flux below the meniscus drastically drops at positions below the meniscus whereas in the continuous casting method according to the present invention, the heat flux falls from $4\times10^6$ to $3\times10^6$ kcal/m$^2$hr due to the transverse grooves having recess area ratio of 50% and depth of 0.2 mm, for example as shown in FIG. 3, and reaches a substantially constant level as represented by a dash line a on the left side of FIG. 4(*a*). As a result, whereas the shrinkage profile of the solidified shell describes a complicated curve in accordance with the drastic change of the heat flux according to the prior art as shown in FIG. 4(*b*), the shrinkage profile can be brought close to a simple straight line as represented in FIG. 4(*c*) according to the present invention. In the present invention, the solidification shrinkage also falls with decreasing heat flux due to air gap of the groove portion and, as a result, the gap (air gap) between solidification shell and casting mold becomes small. Accordingly, the gap between the billet and the casting mold can be easily reduced and eccentricity of the casting (billet) can be minimized by shaping the inner surface of the casting mold into a straight line taper having a suitable angle (e.g. 0.3 to 1.2%/m).

Figure 5:
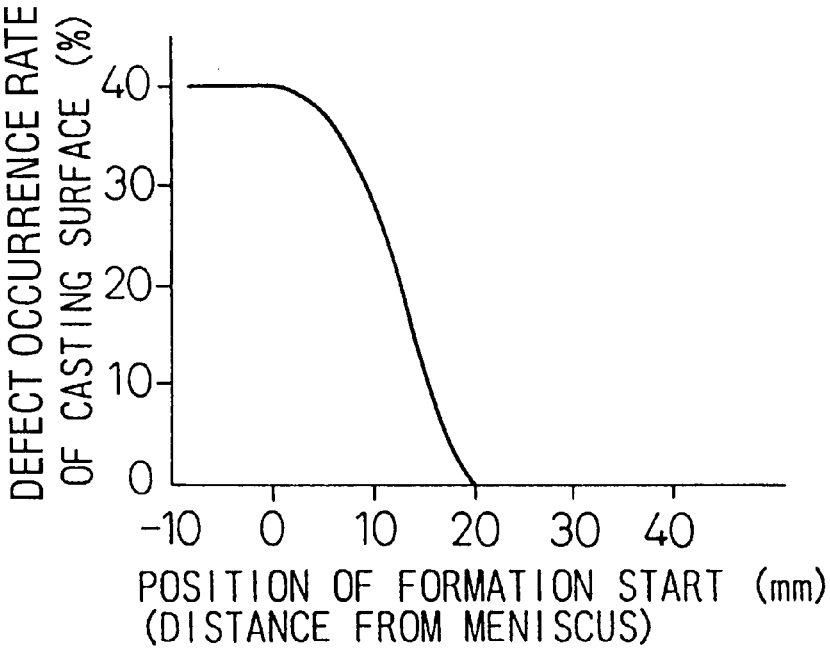
FIG. 5 is a graph showing the relationship between a formation start position of groove or dimple and a billet surface defect occurrence ratio.
Figure 6:
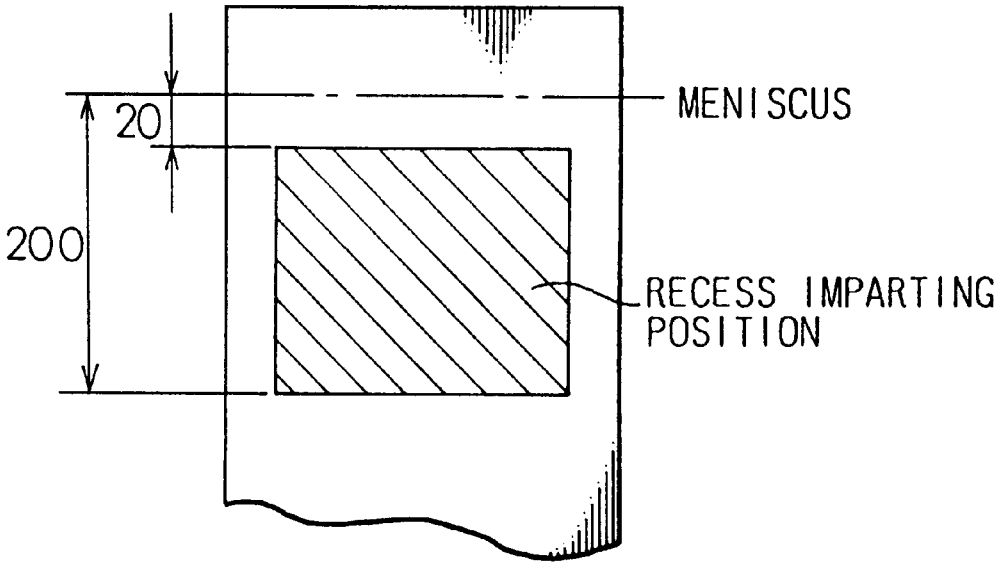
FIG. 6 is an explanatory view showing a portion forming recess on the mold surface.

At least one groove or a large number of dimples forming the recess portions described above are formed within a distance of 200 mm from the lowermost position of the meniscus moving up and down under the steady operation state. The solidified shell is formed at this portion, and the molten metal and the recess portions come into mutual contact through the solidified shell. As a result, penetration of the molten metal does not occur, and sufficiently wider grooves or dimples having sufficiently greater diameters than the recess in the prior art can be formed. In consequence, clogging due to using carbon powder as the lubricant can be eliminated, too. FIG. 5 shows data of the practical operation. The air gap portion described above is preferably formed at a position below about 15 mm (further preferably, about 20 mm from the meniscus) and not exceeding 200 mm. In this way, surface defects such as a double skin and break-out can be eliminated, and the casting rate can be further increased. By the way, when the recess portion exceeds 200 mm from the meniscus, the effect of preventing rhomboidity hardly exists because the thickness of the solidified shell is too great. More, in a round casting mold, the effects preventing side periphery deformation are almost eliminated, too. It is a matter of course that the present invention can be applied to powder casting using a powder as a lubricant.

Figure 7:
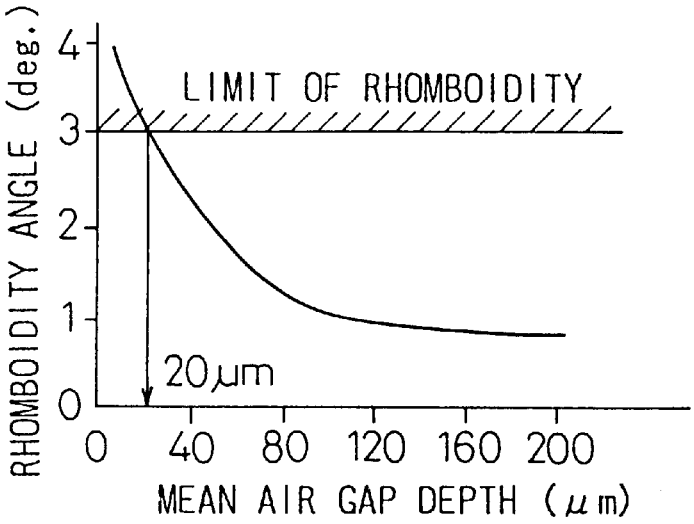
FIG. 7 is a graph showing the relationship between a mean air gap depth and a rhomboidity angle.

Particularly in the case of the casting mold used for continuous casting of the billet according to the present invention, the transverse grooves (slits) having a mean air gap (recess) depth of at least 20 $\mu$m are formed on the inner surface of the casting mold. This is because the rhomboidity angle becomes greater than 3 degree when the mean air gap (recess) depth is smaller than 20 $\mu$m as is obvious from the data shown in FIG. 7. By the way, when the depth of the transverse groove is at least 0.1 mm, the heat flux becomes stable and the rhomboidity becomes smaller than 1 degree, and the operation is preferably carried out under this condition.

Figure 8:
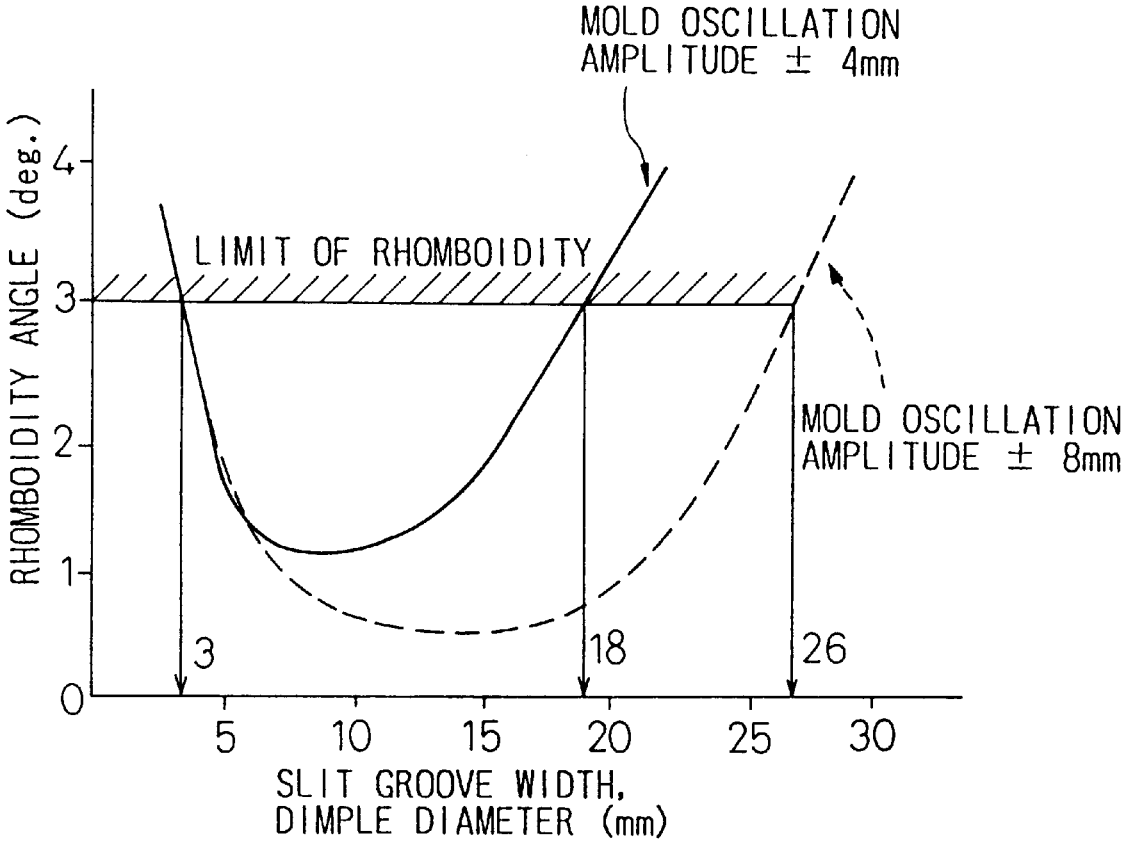
FIG. 8 is a graph showing a relationship between a diameter of groove or dimple and a rhomboidity angle.
Figure 9A:
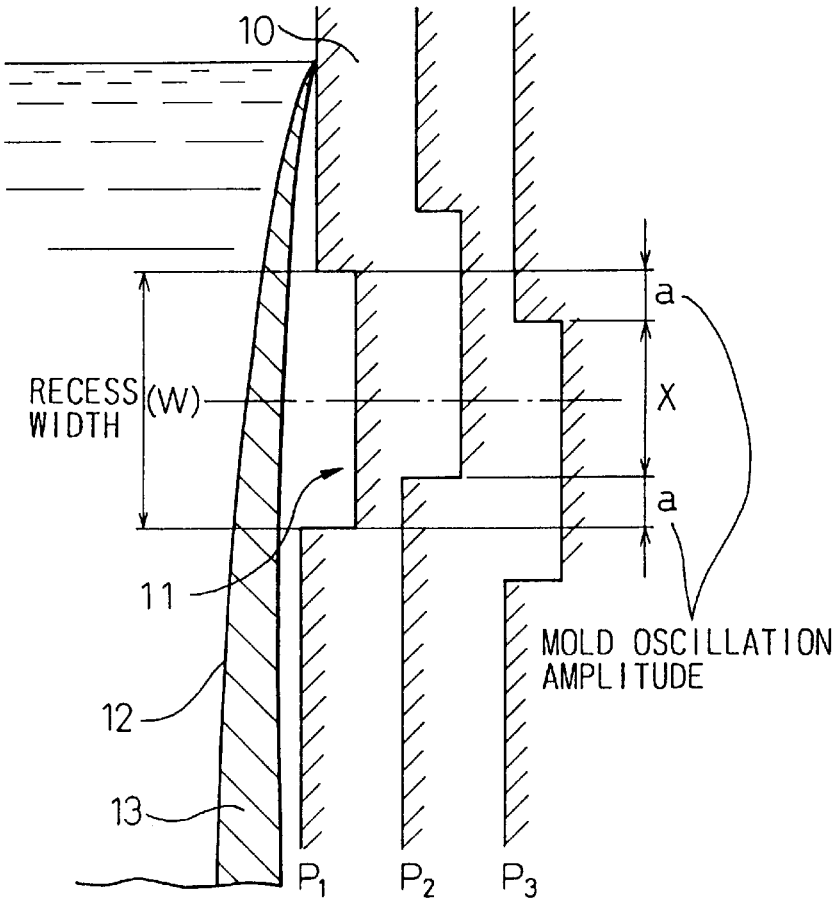
FIG. 9(*a*) is an explanatory view of a mold oscillation, and FIG. 9(*b*) is a view showing the oscillation.
Figure 9B:
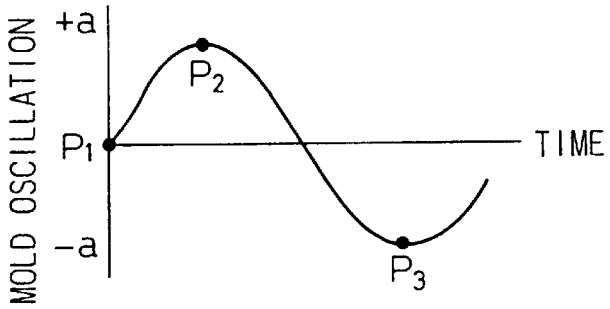
Figure 10:
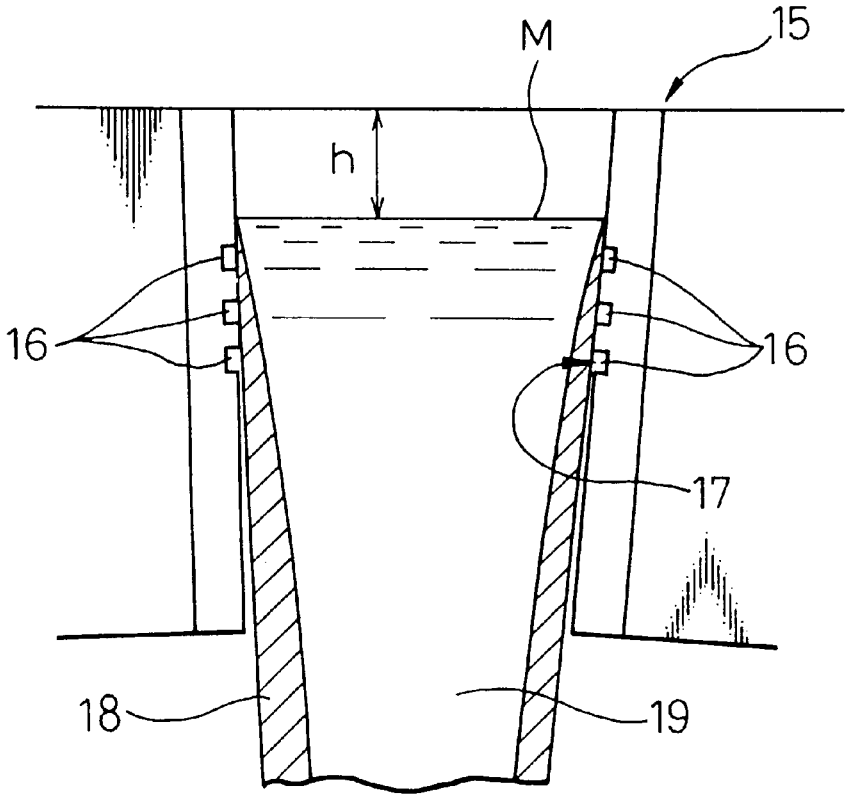
FIG. 10 is a sectional view of a casting mold used for continuous casting of a billet according to one example of the present invention.

The width (W) of the transverse groove is stipulated by the aforementioned formula (1). If the width is smaller than 3 mm, carbon powder as the lubricant fills up the transverse groove during steady operation as described already, so that the transverse groove does not exist any longer, the rhomboidity angle becomes greater than 3 degree as shown in FIG. 8, and the product becomes a defective product. More, FIG. 9(*a*) is an explanatory view of a mold oscillation, and FIG. 9(*b*) is a view showing the oscillation. In these figures, since the casting mold 10 is oscillated in the vertical direction as shown in FIG. 10, the portion of the transverse groove 11 moves up and down, and the width (x) when the transverse groove is always formed becomes (W−2a). If the transverse groove 11 formed on the inner surface of the casting mold 10 is wide, the solidified shell 13 is pushed into the groove by the molten metal 12 charged into the solidified shell 13, and defects occur in the product. As is obvious from FIG. 8, too, when the balance obtained by subtracting double the oscillation stroke (a) exceeds 10 mm, the rhomboidity angle becomes greater than 3 degree. Therefore, when the width is determined in accordance with the formula (1), a billet having a rhomboidity angle of not greater than 3 degree can be continuously cast. More, in a round casting mold, it corresponds to a degree of perfect circle of not greater than 3%.

In the casting mold used for continuous casting of a billet according to the present invention, too, a large number of dimples which have a mean recess depth of at least 20 $\mu$m and whose diameter (D) satisfies the aforementioned formula (2) are formed at positions below the lowermost position of the meniscus, under the steady operation state, and within a distance of 200 mm. This numerical value is limited for the same reason as in the aforementioned case.

Next, the case where the recess portion is constituted by a longitudinal groove will be examined. Since the longitudinal groove is continuously formed on the inner surface of the casting mold in the advancing direction of the solidified shell, the solidified shell pushed by the molten metal continuously enters the groove, and consequently, the longitudinal groove is transferred to the surface of the billet. As a result, the surface properties are extremely deteriorated, and product defects such as surface cracks of the billet or its crack during rolling are likely to occur. Further, the problem of break-out occurs due to a solidification delay portion corresponding to the longitudinal groove below the mold during high speed casting.

On the other hand, because the recess portion comprises the transverse groove or the dimples as aforementioned, their shapes are not transferred to the surface of the billet, and the defects described above do not occur.

EXAMPLE

Example 1

The present invention will be explained in detail with reference to the accompanying drawings.

Figure 11:
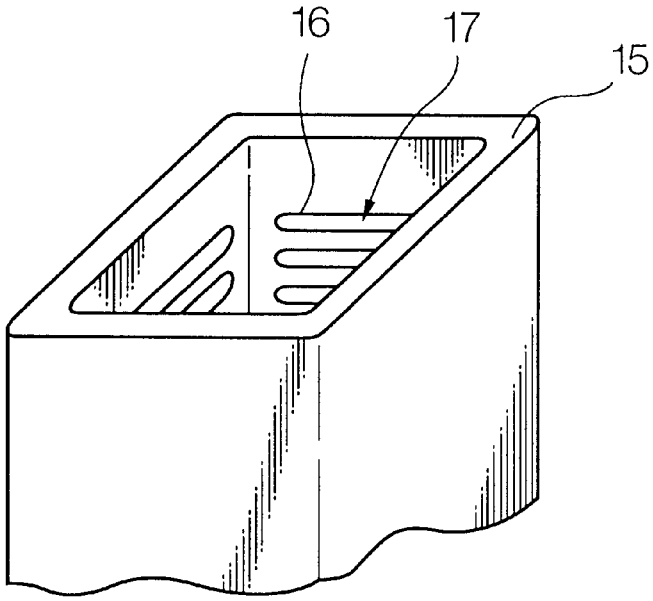
FIG. 11 is a partial perspective view of FIG. 10.
Figure 12:
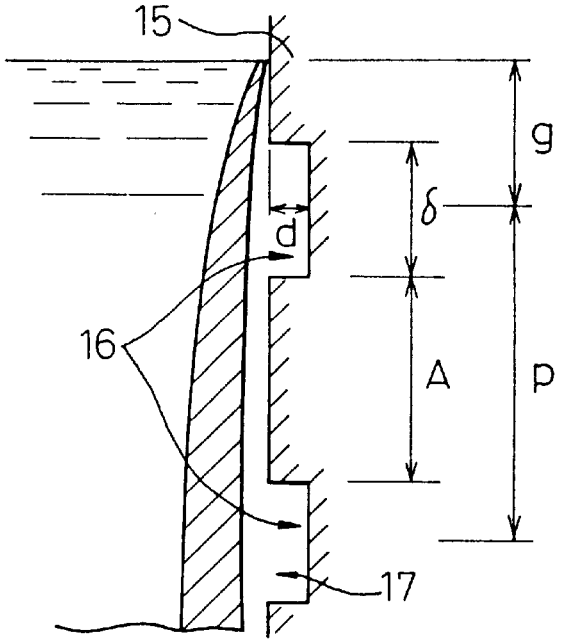
FIG. 12 is a partial detailed view of FIG. 10.
Figure 13:
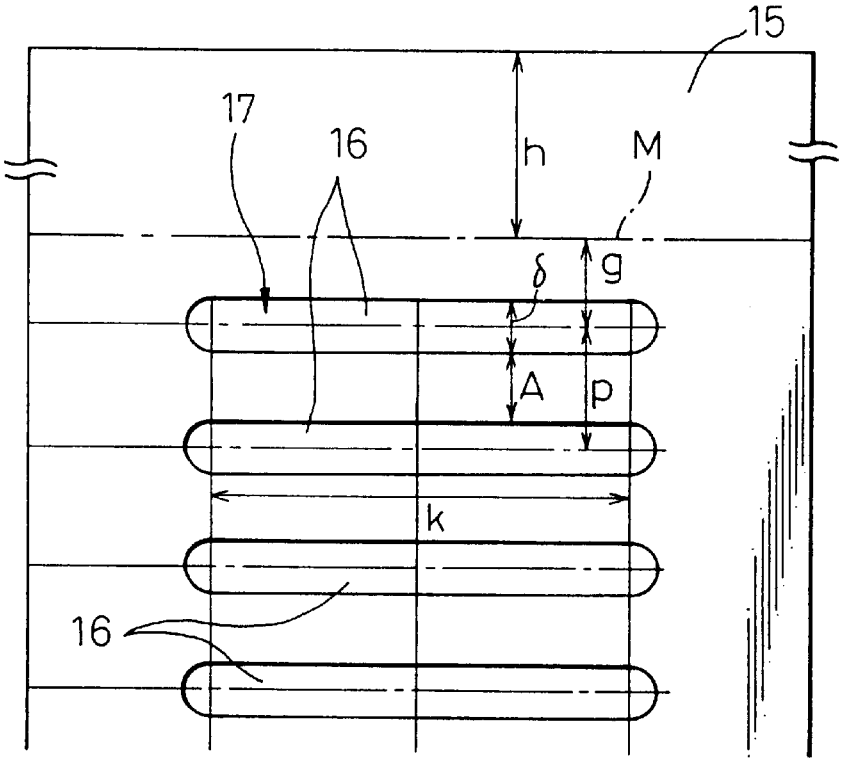
FIG. 13 is a partial enlarged view of FIG. 10.
Figure 14:
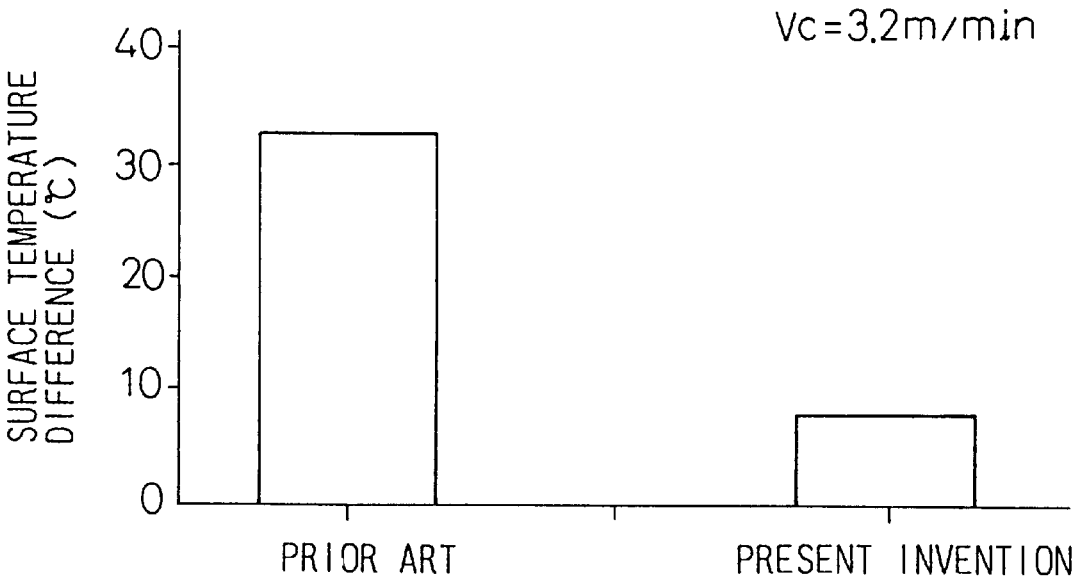
FIG. 14 is a graph showing surface temperature differences of a casting mold according to the present invention and the prior art.
Figure 15:
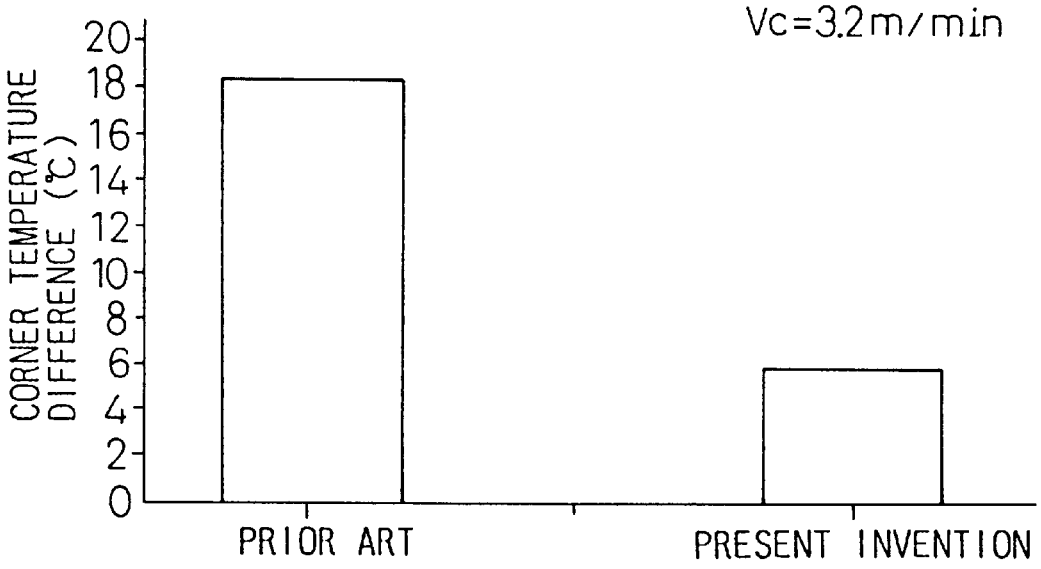
FIG. 15 is a graph showing a corner temperature difference of a casting mold according to an example of the present invention and the prior art.

FIG. 10 is a sectional view of a casting mold used for continuous casting of a billet in accordance with an embodiment of the present invention, and FIG. 11 is a partial perspective view of FIG. 10, FIG. 12 is a partial detailed view of FIG. 10, FIG. 13 is a partial exploded explanatory view of FIG. 10. FIG. 14 is a graph showing a surface temperature difference of the casting mold according to the present invention and the prior art, FIG. 15 is a graph showing a corner temperature difference of a casting mold according to an example of the present invention and the prior art, FIG. 16(*a*) is a view of a round dimple, FIG. 16(*b*) of angular dimple, and FIG. 16(*c*) of hexagonal dimple. FIG. 17 is an explanatory view showing the usable ranges of the casting mold according to the present invention and the casting mold according to the prior art.

As shown in FIGS. 10 to 12, a mold taper of the casting mold 15 for continuous casting of a billet according to an embodiment of the present invention is 0.6%/m and its upper inner periphery has the shape of a square having a side of 133 mm. The distance h from the upper end of the casting mold 15 to the lowermost position M of the meniscus formed under the steady state (hereinafter merely referred to as the "meniscus") is about 100 mm.

Recess portions 17 are formed by disposing four equivalently arranged transverse grooves 16 each having a width δ (=12 mm), a length K (=70 mm) and a depth d (=1 mm) with a pitch p (=25 mm) at positions having a distance g (=20 mm) from the meniscus M (see FIG. 13). Square billets having a side of 130 mm were produced by continuously casting molten steels having the components and properties tabulated in Table 1 by using this casting mold 15.

TABLE 1

| item | | casting condition |
|---|---|---|
| billet size | | □130 mm |
| steel kind | | SD295 |
| molten steel temperature | | 1560° C. |
| mold cooling water quantity | | 1370 l/min. |
| secondary cooling water quantity | | 700 l/min. |
| oscillation amplitude | | ±4 mm |
| mold taper | | 0.6 %/m |
| component (%) | C | 21 |
| x $10^{-2}$ | Si | 18 |
| | Mn | 59 |
| | P | 3.2 |
| | S | 2.9 |
| | Cu | 29 |
| | Ni | 8 |
| | Cr | 10 |
| | Sn | 17 |

FIGS. 14 and 15 show the result of measurement of the temperature difference (maximum temperature—minimum temperature) at the center and corner portions of the mold copper sheet at a position having a distance of about 150 mm from the upper end of the casting mold 15 in comparison with the value of the casting mold according to the prior art (that is, the casting mold not having the recess portions). It can be understood that the embodiment of the present invention had a smaller temperature difference than the casting mold according to the prior art. Accordingly, the difference of the gap between the casing mold 15 and the solidified shell 18 decreased as shown in FIGS. 14 and 15, non-uniform cooling of the peripheral surface of the solidified shell 18 could be mitigated, and the rhomboidity of the billet became small (not greater than 1 degree).

Since the solidified shell 18 was sufficiently formed at the recess portion 17, the solidified shell 18 did not enter the transverse groove 16 even when it was pushed by the molten steel 19, and even when the casting mold 15 was used for a long time, clogging by the carbides of the rape seed oil, as an example of the lubricant charged from above the casting mold 15, did not occur.

Table 2 shows the degrees of rhomboidity of the billets produced by variously changing the groove depth (d), the recess area ratio, the groove width (δ), the bank with (A) and the groove pitch (p), and in all of the cases, the degree of rhomboidity was satisfactory.

TABLE 2

| mean air gap depth (μm) | groove depth d (mm) | recess area ratio (%) | groove width δ (mm) | bank width A (mm) Max | bank width A (mm) Min | groove pitch P (mm) Max | groove pitch P (mm) Min | rhomboidity |
|---|---|---|---|---|---|---|---|---|
| at least 20 | 0.1 | 20–84 | 26 | 104 | 5 | 130 | 31 | not more than 3 degrees |
| | | | 15 | 60 | | 75 | 20 | |
| | | | 8 | 32 | | 40 | 13 | |
| | | | 5 | 20 | | 25 | 10 | |
| | | | 3 | 12 | | 15 | 8 | |
| | 0.2 | 10–84 | 26 | 234 | 5 | 260 | 31 | |
| | | | 15 | 135 | | 150 | 20 | |
| | | | 8 | 72 | | 80 | 13 | |
| | | | 5 | 45 | | 50 | 10 | |
| | | | 3 | 27 | | 30 | 8 | |
| | 0.3 | 6.7–84 | 26 | 362 | 5 | 388 | 31 | |
| | | | 15 | 209 | | 224 | 20 | |
| | | | 8 | 111 | | 119 | 13 | |
| | | | 5 | 70 | | 75 | 10 | |
| | | | 3 | 42 | | 45 | 8 | |
| | 0.5 | 4–75 | 15 | 360 | 5 | 375 | 20 | |
| | | | 8 | 192 | | 200 | 13 | |
| | | | 5 | 120 | | 125 | 10 | |
| | | | 3 | 72 | | 75 | 8 | |
| | 0.7 | 2.9–75 | 15 | 502 | 5 | 517 | 20 | |
| | | | 8 | 268 | | 276 | 13 | |
| | | | 5 | 167 | | 172 | 10 | |
| | | | 3 | 100 | | 103 | 8 | |
| | 1.0 | 2–75 | 15 | 735 | 5 | 750 | 20 | |
| | | | 8 | 392 | | 400 | 13 | |

TABLE 2-continued

| mean air gap depth (μm) | groove depth d (mm) | recess area ratio (%) | groove width δ (mm) | bank width A (mm) Max | bank width A (mm) Min | groove pitch P (mm) Max | groove pitch P (mm) Min | rhomboidity |
|---|---|---|---|---|---|---|---|---|
| | | | 5 | 245 | | 250 | 10 | |
| | | | 3 | 147 | | 150 | 8 | |

Figure 16A:
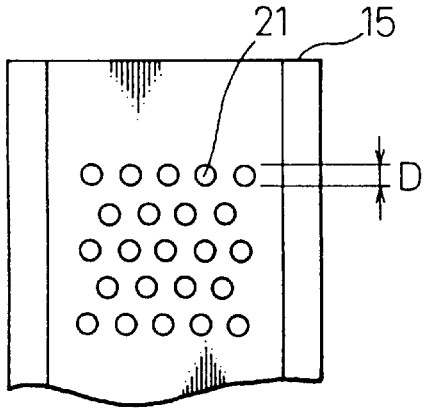
FIG. 16(*a*) is a view of round dimple, FIG. 16(*b*) of angular dimple, and FIG. 16(*c*) of hexagonal dimple.
Figure 16B:
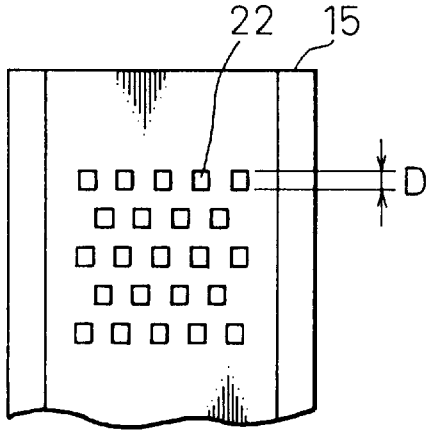
Figure 16C:
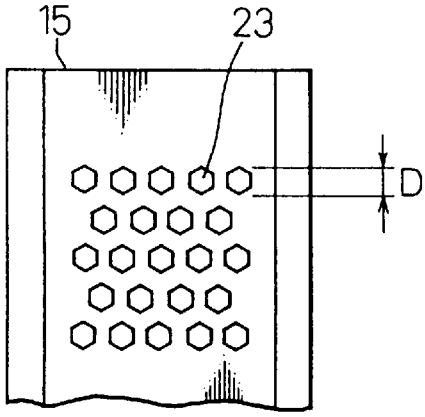
Figure 17:
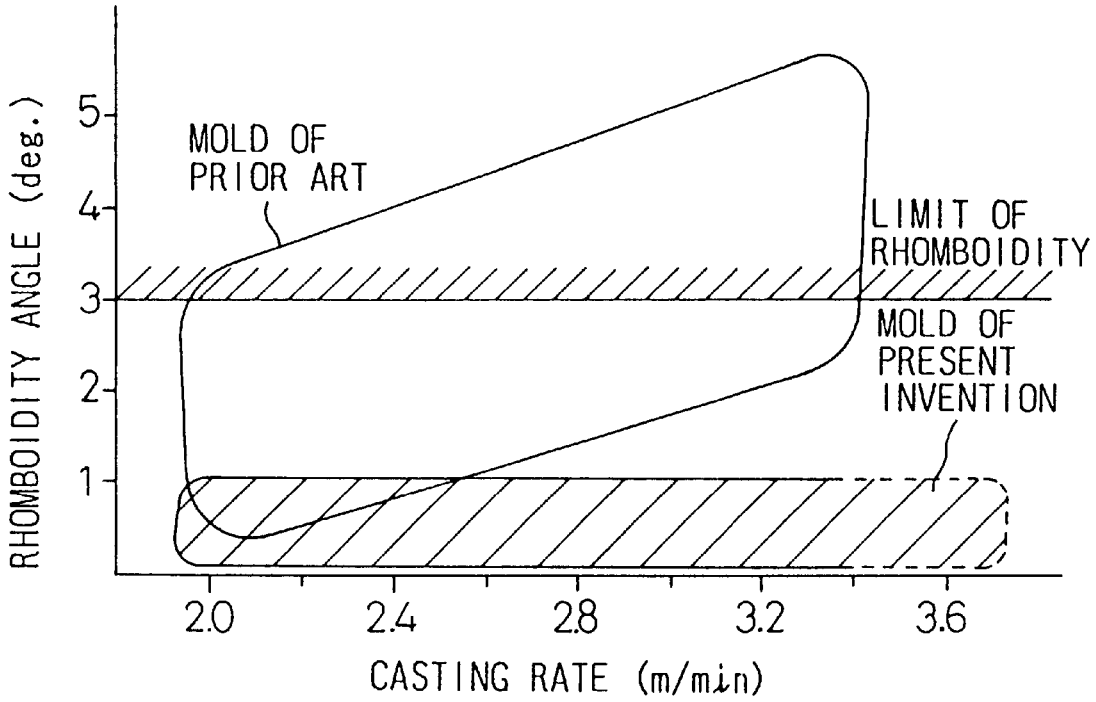
FIG. 17 is an explanatory view of a usable range of a casting mold according to an example of the present invention and the prior art.
Figure 18:
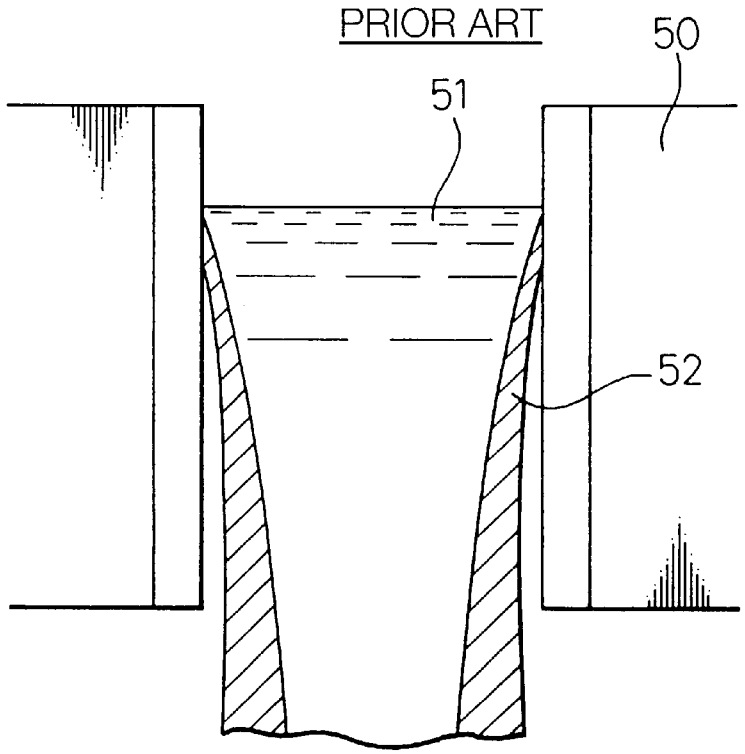
FIG. 18 is an explanatory view of a casting mold according to the prior art.

FIGS. 16(*a*)–16(*c*) show the mode of formation of the recess portion in the casting mold according to another embodiment of the present invention. FIG. 16(*a*) shows a large number of round dimples 21, FIG. 16(*b*) shows a large number of square dimples 22 and FIG. 16(*c*) shows a large number of hexagonal dimples 23. In all of these cases, the mean recess depth (a mean value of the bank portion and the depth of the groove or dimple) is from about 0.1 to about 0.5 mm, the groove width or the dimple diameter is at least 3 mm and not greater than (oscilation amplitude)×2+10 mm, and the mean area ratio of the groove or dimple is 15 to 80%. When this range is satisfied, the rhomboidity of the billets produced was not greater than 1 degree even at a casting speed of about 3 m/min.

FIG. 17 shows the comparison of the case where the billets were produced by using the casting molds of the embodiment described above with the case where the billets were produced by using the casting mold according to the prior art. As indicated by hatched lines, it can be understood that the rhomboidity was not greater than 1 degree even within the high speed casting region when the casting mold according to the embodiment of the present invention was used.

Incidentally, the straight line taper in the embodiment described above is only one stage but the present invention can be applied to two-stage taper, multi-stage taper or parabolic taper.

Example 2

Figure 19A:
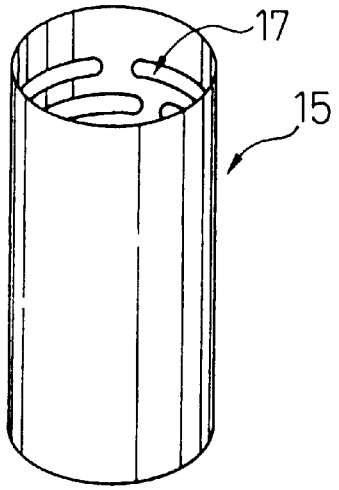
FIG. 19(*a*) is a perspective view of a round casting mold according to an example of the invention, FIG. 19(*b*) is an exploded explanatory view of a recess portion on the mold surface.
Figure 19B:
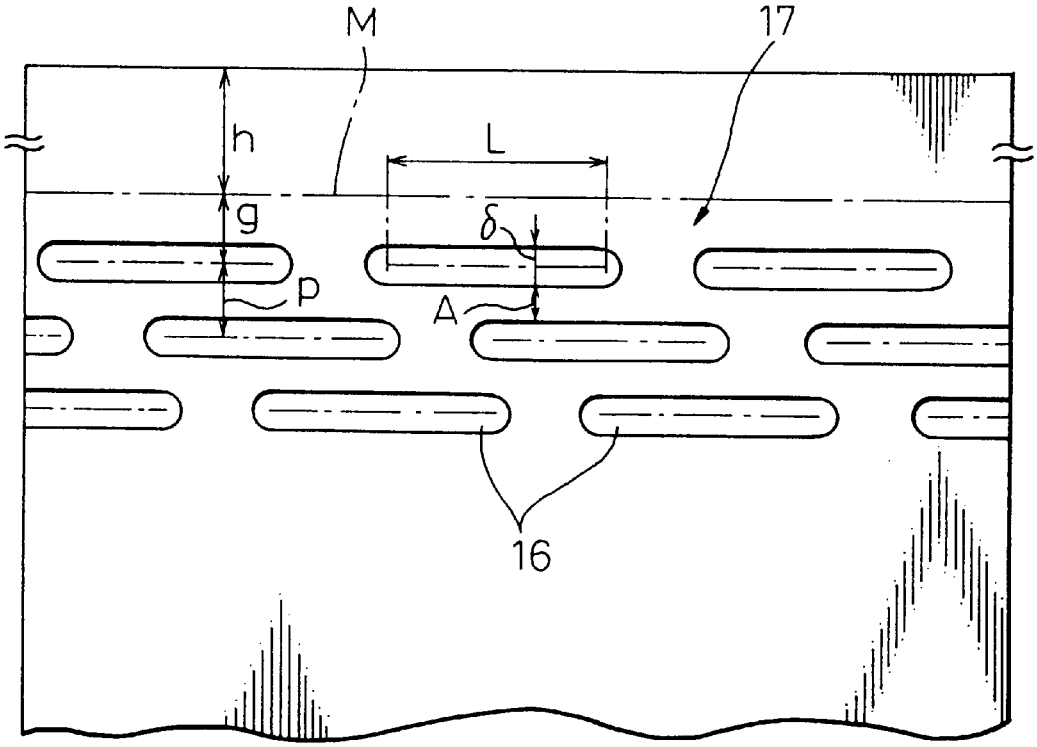

The example is an application of the present invention to continuous casting of a round billet. FIG. 19 is an exploded explanatory view of a recess portion formed inside the casting mold.

As shown in FIG. 19, a mold taper of the casting mold 15 for continuous casting of a round billet according to an embodiment of the present invention is 0.6%/m and its upper inner periphery has the shape of a circle having a diameter of 133 mm. The distance h from the upper end of the casting mold 15 to the lowermost position M of the meniscus formed under the steady state (hereinafter merely referred to as the "meniscus") is about 100 mm.

Recess portions 17 are formed by disposing substantially zigzag three transverse grooves 16 each having a width δ (=12 mm), a length L (=100 mm) and a depth d (=1 mm) with a pitch p (=25 mm) at positions having a distance g (=20 mm) from the meniscus M (see FIG. 19). Round billets having a diameter of about 130 mm were produced by continuously casting molten steels having the components and properties tabulated in Table 3 using this casting mold 15.

TABLE 3

| item | | casting condition |
|---|---|---|
| billet size | | ϕ130 mm |
| steel kind | | SD295 |
| molten steel temperature | | 1560° C. |
| mold cooling water quantity | | 1370 l/min. |
| secondary cooling water quantity | | 700 l/min. |
| oscillation amplitude | | ±4 mm |
| mold taper | | 0.6 %/m |
| component (%) | C | 20 |
| x $10^{-2}$ | Si | 17 |
| | Mn | 60 |
| | P | 3.2 |
| | S | 2.8 |
| | Cu | 27 |
| | Ni | 4 |
| | Cr | 9 |
| | Sn | 17 |

Incidentally, the degree of perfect circle (%) is defined by the following formula where the maximum diameter of the circle is $D_{max}$ and its minimum diameter, $D_{min}$:

$$\text{degree of perfect circle}=200\times(D_{max}-D_{mon})/(D_{max}+D_{min})$$

Figure 20:
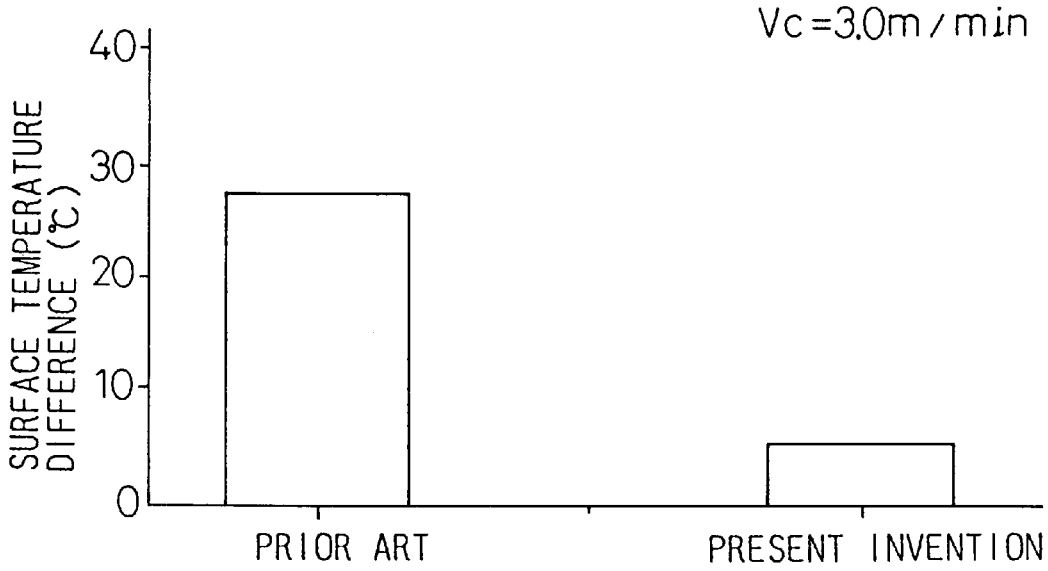
FIG. 20 is a graph showing surface temperature differences of a casting mold according to an example of the present invention and the prior art.

FIG. 20 shows the result of measurement of the surface temperature difference (maximum temperature—minimum temperature) at the center portion of the mold copper sheet at a position having a distance of about 150 mm from the upper end of the casting mold 15 in comparison with the value of the casting mold according to the prior art (that is, the casting mold not having the recess portions). It can be understood that the embodiment of the present invention had a smaller surface temperature difference than the casting mold according to the prior art. Accordingly, the difference of the gap between the casting mold and the solidified shell decreased as shown in FIG. 20, non-uniform cooling of the peripheral surface of the solidified shell could be mitigated, and the degree of perfect circle of the round billet became small (not greater than 1%).

Since the solidified shell was sufficiently formed at the recess portion, the solidified shell did not enter the transverse groove even when it was pushed by the molten steel, and even when the casting mold was used for a long time, clogging by the carbides of the rape seed oil, as an example of the lubricant charged from above the casting mold, did not occur.

Table 4 shows the degrees of perfect circle of the round billets produced by variously changing the groove depth (d), the recess area ratio, the groove width (δ), the bank width (A) and the groove pitch (p), and in all of the cases, the degree of perfect circle was satisfactory.

TABLE 4

| mean air gap depth (μm) | groove depth d (mm) | recess area ratio (%) | groove width δ (mm) | bank width A (mm) Max | bank width A (mm) Min | groove pitch P (mm) Max | groove pitch P (mm) Min | rhomboidity |
|---|---|---|---|---|---|---|---|---|
| at least 20 | 0.1 | 20–84 | 26 | 104 | 5 | 130 | 31 | not more than 3% |
| | | | 15 | 60 | | 75 | 20 | |
| | | | 8 | 32 | | 40 | 13 | |
| | | | 5 | 20 | | 25 | 10 | |
| | | | 3 | 12 | | 15 | 8 | |
| | 0.2 | 10–84 | 26 | 234 | 5 | 260 | 31 | |
| | | | 15 | 135 | | 150 | 20 | |

TABLE 4-continued

| mean air gap depth (μm) | groove depth d (mm) | recess area ratio (%) | groove width δ (mm) | bank width A (mm) Max | bank width A (mm) Min | groove pitch P (mm) Max | groove pitch P (mm) Min | rhomboidity |
|---|---|---|---|---|---|---|---|---|
| | | | 8 | 72 | | 80 | 13 | |
| | | | 5 | 45 | | 50 | 10 | |
| | | | 3 | 27 | | 30 | 8 | |
| | 0.3 | 6.7–84 | 26 | 362 | 5 | 388 | 31 | |
| | | | 15 | 209 | | 224 | 20 | |
| | | | 8 | 111 | | 119 | 13 | |
| | | | 5 | 70 | | 75 | 10 | |
| | | | 3 | 42 | | 45 | 8 | |
| | 0.5 | 4–75 | 15 | 360 | 5 | 375 | 20 | |
| | | | 8 | 192 | | 200 | 13 | |
| | | | 5 | 120 | | 125 | 10 | |
| | | | 3 | 72 | | 75 | 8 | |
| | 0.7 | 2.9–75 | 15 | 502 | 5 | 517 | 20 | |
| | | | 8 | 268 | | 276 | 13 | |
| | | | 5 | 167 | | 172 | 10 | |
| | | | 3 | 100 | | 103 | 8 | |
| | 1.0 | 2–75 | 15 | 735 | 5 | 750 | 20 | |
| | | | 8 | 392 | | 400 | 13 | |
| | | | 5 | 245 | | 250 | 10 | |
| | | | 3 | 147 | | 150 | 8 | |

Figure 21:
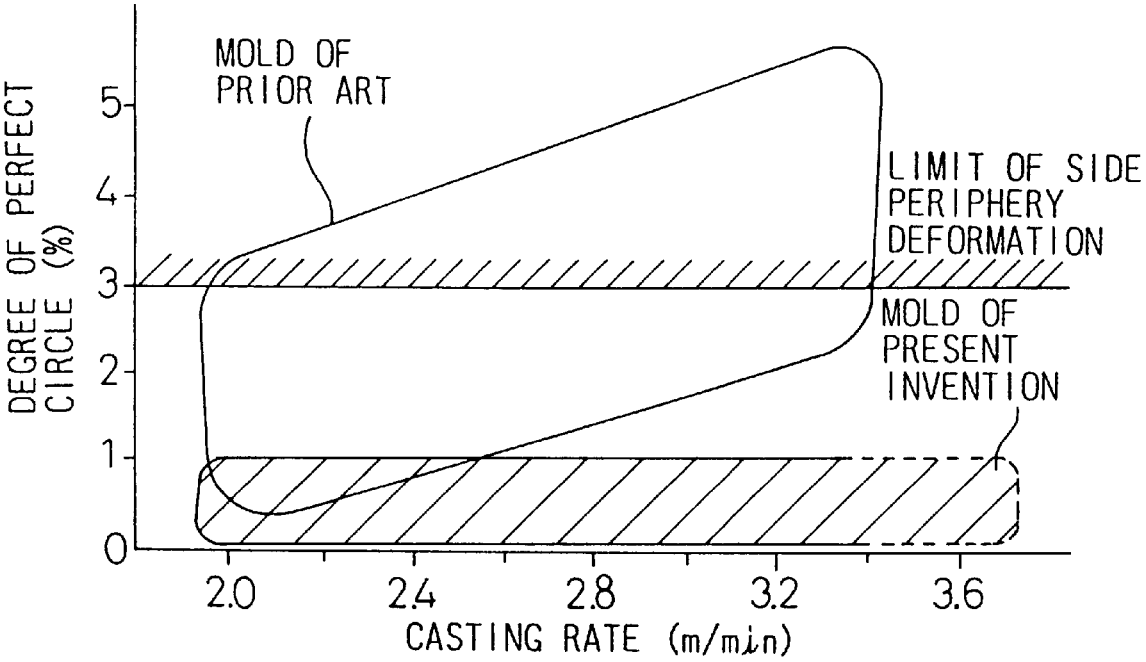
FIG. 21 is an explanatory view of a usable range of a casting mold according to an example of the present invention and the prior art.

FIG. 21 shows the comparison of the case where the round billets were produced by using the casting molds of the embodiment described above with the case where the round billets were produced by using the casting mold according to the prior art. As indicated by hatched lines, it can be understood that the degree of perfect circle was not greater than 1% even within the high speed casting region when the casting mold according to the embodiment of the present invention was used.

Example 3

This example is a application of the present invention to a casting mold having a two stage linear taper. The mold tapers of the casting mold for continuous casting of a billet according to an embodiment of the present invention are 1.5%/m of the first stage and 0.6%/m of the second stage. In this example, other casting conditions are same as the example 1. In this example, square billets having a side of 130 mm were produced by continuously casting molten steels having the components and properties tabulated in Table 5.

TABLE 5

| item | | casting condition |
|---|---|---|
| billet size | | □130 mm |
| steel kind | | SD295 |
| molten steel temperature | | 1560° C. |
| mold cooling water quantity | | 1370 l/min. |
| secondary cooling water quantity | | 700 l/min. |
| oscillation amplitude | | ±4 mm |
| mold taper | | 1st stage: 1.5 %/m<br>2nd stage: 0.6 %/m |
| component (%) | C | 21 |
| x $10^{-2}$ | Si | 18 |
| | Mn | 59 |
| | P | 3.2 |
| | S | 2.9 |
| | Cu | 29 |
| | Ni | 8 |
| | Cr | 10 |
| | Sn | 17 |

Since the solidified shell was sufficiently formed at the recess portion, too, the solidified shell did not enter the transverse groove even when it was pushed by the molten steel, and even when the casting mold was used for a long time, clogging by the carbides of the rape seed oil, as an example of the lubricant charged from above the casting mold, did not occur.

Table 6 shows the degrees of rhomboidity of the billets produced by variously changing the groove depth (d), the recess area ratio, the groove width (δ), the bank width (A) and the groove pitch (p), and in all of the cases, the degree of rhomboidity was satisfactory.

TABLE 6

| mean air gap depth (μm) | groove depth d (mm) | recess area ratio (%) | groove width δ (mm) | bank width A (mm) Max | bank width A (mm) Min | groove pitch P (mm) Max | groove pitch P (mm) Min | rhomboidity |
|---|---|---|---|---|---|---|---|---|
| at least 20 | 0.1 | 20–84 | 26 | 104 | 5 | 130 | 31 | not more than 3 degrees |
| | | | 15 | 60 | | 75 | 20 | |
| | | | 8 | 32 | | 40 | 13 | |
| | | | 5 | 20 | | 25 | 10 | |
| | | | 3 | 12 | | 15 | 8 | |
| | 0.2 | 10–84 | 26 | 234 | 5 | 260 | 31 | |
| | | | 15 | 135 | | 150 | 20 | |
| | | | 8 | 72 | | 80 | 13 | |
| | | | 5 | 45 | | 50 | 10 | |
| | | | 3 | 27 | | 30 | 8 | |
| | 0.3 | 6.7–84 | 26 | 362 | 5 | 388 | 31 | |
| | | | 15 | 209 | | 224 | 20 | |
| | | | 8 | 111 | | 119 | 13 | |
| | | | 5 | 70 | | 75 | 10 | |
| | | | 3 | 42 | | 45 | 8 | |
| | 0.5 | 4–75 | 15 | 360 | 5 | 375 | 20 | |
| | | | 8 | 192 | | 200 | 13 | |
| | | | 5 | 120 | | 125 | 10 | |
| | | | 3 | 72 | | 75 | 8 | |
| | 0.7 | 2.9–75 | 15 | 502 | 5 | 517 | 20 | |
| | | | 8 | 268 | | 276 | 13 | |
| | | | 5 | 167 | | 172 | 10 | |
| | | | 3 | 100 | | 103 | 8 | |
| | 1.0 | 2–75 | 15 | 735 | 5 | 750 | 20 | |
| | | | 8 | 392 | | 400 | 13 | |
| | | | 5 | 245 | | 250 | 10 | |
| | | | 3 | 147 | | 150 | 8 | |

INDUSTRIAL APPLICABILITY

According to the present invention, the casting mold used for continuous casting of the billet can produce the billet having less rhomboidity and side periphery deformation in a round billet even by high-speed casting, and can improve productivity of high quality products.

Further, service life of the casting mold can be drastically extended due to gradual cooling brought forth by the formation of the recess portion, and the occurrence of depressions (recess deformation) can be prevented, too.

What is claimed is:

1. A casting mold for casting molten metal comprising:

said casting mold having a substantially square inner surface;

transverse grooves having a mean recess depth of at least 20 μm and having the width (W) thereof disposed on the inner surface of said casting mold;

means for oscillating said casting mold in a vertical direction at a given oscillation amplitude of said casting mold;

said oscillation amplitude of said casting mold and said width (W) of said transverse grooves satisfying the relationship:

$$3\text{mm} \leqq W \leqq (\text{oscillation amplitude of said casting mold}) \times 2 + 10\text{mm}.$$

2. A casting mold for casting molten metal comprising:

said casting mold having a substantially square inner surface;

a large number of dimples having a mean recess depth of at least 20 μm and having a diameter (D) thereof disposed with gaps between them on the inner surface of said casting mold;

means for oscillating said casting mold in a vertical direction at a given oscillation amplitude of said casting mold;

said oscillation amplitude of said casting mold and said diameter (D) of said dimples satisfying the relationship:

$$3\text{mm} \leqq D \leqq (\text{oscillation amplitude of said casting mold}) \times 2 + 10\text{mm}.$$

3. A casting mold for casting molten metal comprising:

said casting mold having a substantially square inner surface;

the inner surface of said casting mold having a taper in such a fashion that the inner surface distance thereof progressively decreases downward;

transverse grooves having a mean recess depth of at least 20 μm and having the width (W) thereof disposed on the inner surface of said casting mold;

means for oscillating said casting mold in a vertical direction at a given oscillation amplitude of said casting mold;

said oscillation amplitude of said casting mold and said width (W) of said traverse grooves satisfying the relationship:

$$3\text{mm} \leqq W \leqq (\text{oscillation amplitude of said casting mold}) \times 2 + 10\text{mm}.$$

4. A casting mold for casting molten metal comprising:

said casting mold having a substantially square inner surface;

the inner surface of said casting mold having a taper in such a fashion that the inner surface distance thereof progressively decreases downward;

a large number of dimples having a mean recess depth of at least 20 μm and having a diameter (D) thereof disposed with gaps between them on the inner surface of said casting mold;

means for oscillating said casting mold in a vertical direction at a given oscillation amplitude of said casting mold;

said oscillation amplitude of said casting mold and said diameter (D) of said dimples satisfying the relationship:

$$3\text{mm} \leqq D \leqq (\text{oscillation amplitude of said casting mold}) \times 2 + 10\text{mm}.$$

5. A casting mold for casting molten metal comprising:

said casting mold having a substantially round inner surface tapered in such a fashion that said round inner surface diameter progressively decreases downward;

transverse grooves having a recess depth of at least 20 μm and having the width (W) thereof disposed on the inner surface of said casting mold;

means for oscillating said casting mold in a vertical direction at a given oscillation amplitude of said casting mold;

said oscillation amplitude of said casting mold and said width (W) of said transverse grooves satisfying the relationship:

$$3\text{mm} \leqq W \leqq (\text{oscillation amplitude of said casting mold}) \times 2 + 10\text{mm}.$$

6. A casting mold for casting molten metal comprising:

said casting mold having a substantially round inner surface tapered in such a fashion that said round inner surface diameter progressively decreases downward;

a large number of dimples having a mean recess depth of at least 20 μm and having a diameter (D) thereof disposed with gaps between them on the inner surface of said casting mold;

means for oscillating said casting mold in a vertical direction at a given oscillation amplitude of said casting mold;

said oscillation amplitude of said casting mold and said diameter (D) of said dimples satisfying the relationship:

$$3\text{mm} \leqq D \leqq (\text{oscillation amplitude of said casting mold}) \times 2 + 10\text{mm}.$$

* * * * *